US007144195B1

(12) United States Patent
McCoskey

(10) Patent No.: US 7,144,195 B1
(45) Date of Patent: Dec. 5, 2006

(54) ASPHALT COMPACTION DEVICE

(76) Inventor: William D. McCoskey, P.O. Box 10, Vail, AZ (US) 85641

( * ) Notice: Subject to any disclaimer, the term of this patent is extended or adjusted under 35 U.S.C. 154(b) by 0 days.

(21) Appl. No.: 11/133,694

(22) Filed: May 20, 2005

(51) Int. Cl.
*E01C 19/30* (2006.01)

(52) U.S. Cl. ..... 404/133.1; 404/133.05

(58) Field of Classification Search ..... 404/133.05, 404/133.1; 405/271
See application file for complete search history.

(56) References Cited

U.S. PATENT DOCUMENTS 2,098,895 A * 11/1937 Velten ..... 404/133.05
2,633,782 A * 4/1953 Clement ..... 404/133.1
3,283,677 A * 11/1966 Uebel ..... 404/113
3,814,531 A * 6/1974 Carnahan et al. ..... 404/117
3,965,822 A * 6/1976 Stewart ..... 104/7.2
4,125,075 A * 11/1978 Stewart ..... 104/7.2
5,236,279 A * 8/1993 Grinager ..... 404/133.05
6,293,729 B1 * 9/2001 Greppmair ..... 404/133.1
6,315,500 B1 * 11/2001 Goodman et al. ..... 405/271
6,846,128 B1 * 1/2005 Sick ..... 404/133.05

* cited by examiner

*Primary Examiner*—Gary S Hartmann
(74) *Attorney, Agent, or Firm*—Les A Boegemann

(57) ABSTRACT

An asphalt compaction device including a primary compaction plate and a secondary compaction plate for concentrating force, resulting in an increased compaction rate. The secondary compaction plate may be either rotated or extended into its operative position. The asphalt compaction device may include a single primary compaction plate intended to be moved and steered by a user. Alternatively, the asphalt compaction device may include an articulated machine with multiple primary compaction plates.

6 Claims, 5 Drawing Sheets

Vibrating Compacting Device

Vibrating Compacting Device

ASPHALT COMPACTION DEVICE

BACKGROUND OF THE INVENTION

1. Field of the Invention

This invention is related in general to the field of construction. In particular, the invention consists of a device and method for improved compaction of asphalt.

2. Description of the Prior Art

Asphalt is a material well-known in the construction industry used to create a surface for supporting vehicles. In this capacity, asphalt is often used to create both parking lots and roads. However, the application of asphalt requires many disparate steps to ensure that the finished surface is both smooth and durable.

In order to properly apply asphalt, it is necessary that the asphalt be deposited on the intended surface after it has been heated to a high temperature, producing a pliable and workable material. The required temperature for application may vary based on ambient environmental conditions, the intended use of the product, and local regulations. Those skilled in the art of applying asphalt can readily ascertain the appropriate application temperature.

Once asphalt has been applied, it must be compacted to increase its cohesiveness, to prevent water seepage, and to resist cracking and splitting due to use and changes in its ambient environment. Many methods of compacting asphalt are well known in the art. For example, one method entails the use of large heavy rollers to exert force on the asphalt. However, these rollers not only produce force normal to the surface, but also tend to push the asphalt in front of the roller, forming a ridge or wave of semi-fluid material. In order to reduce this effect, some applications involve rolling newly applied asphalt once or twice and then waiting an extended period of time before rolling the material again. This waiting period extends the time needed to finish the application of the asphalt. Accordingly, it is desirable to have a means for compacting asphalt that reduces or eliminates the wait period inherent in the use of large rollers.

Another method of asphalt compaction entails utilizing a vibrating plate. This plate is often first pushed over the seams of the newly applied asphalt to seal the material where it meets asphalt that has been previously applied. This is especially useful when the asphalt application is for a patch or repair of previously applied asphalt. Once the edges of the new application has been sealed, the vibrating plate is then passed over the rest of the new application, applying a normal force that increases the cohesiveness and seals the asphalt. Using a vibrating plate eliminates the formation of the pressure ridge encountered when using heavy rollers. Accordingly, waiting periods may not be required between passes using a vibrating plate. However, traditional vibrating plates do not produce compaction levels equivalent to those produced by heavy rollers. This results in most asphalt applications either exclusively using heavy rollers with their corresponding wait periods or first using a vibrating plate followed by the use of a heavy roller. Accordingly, it is desirable to have a device that can produce compaction levels equivalent to those produced by heavy rollers without the associated wait periods and without requiring multiple pieces of equipment.

SUMMARY OF THE INVENTION

The invention disclosed herein utilizes a vibrating plate with one or more secondary surfaces used to concentrate and localize the force applied by the vibrating plate. The newly improved vibrating plate may be either a small push-type model that can be moved and steered by a user or a large, articulated machine. The secondary surfaces may either extend across the width of the primary vibrating plate or may include a dynamic shape and size to increase the compaction effectiveness.

Various other purposes and advantages of the invention will become clear from its description in the specification that follows and from the novel features particularly pointed out in the appended claims. Therefore, to the accomplishment of the objectives described above, this invention comprises the features hereinafter illustrated in the drawings, fully described in the detailed description of the preferred embodiments and particularly pointed out in the claims. However, such drawings and description disclose just a few of the various ways in which the invention may be practiced.

DESCRIPTION OF THE PREFERRED EMBODIMENTS

Figure 1:
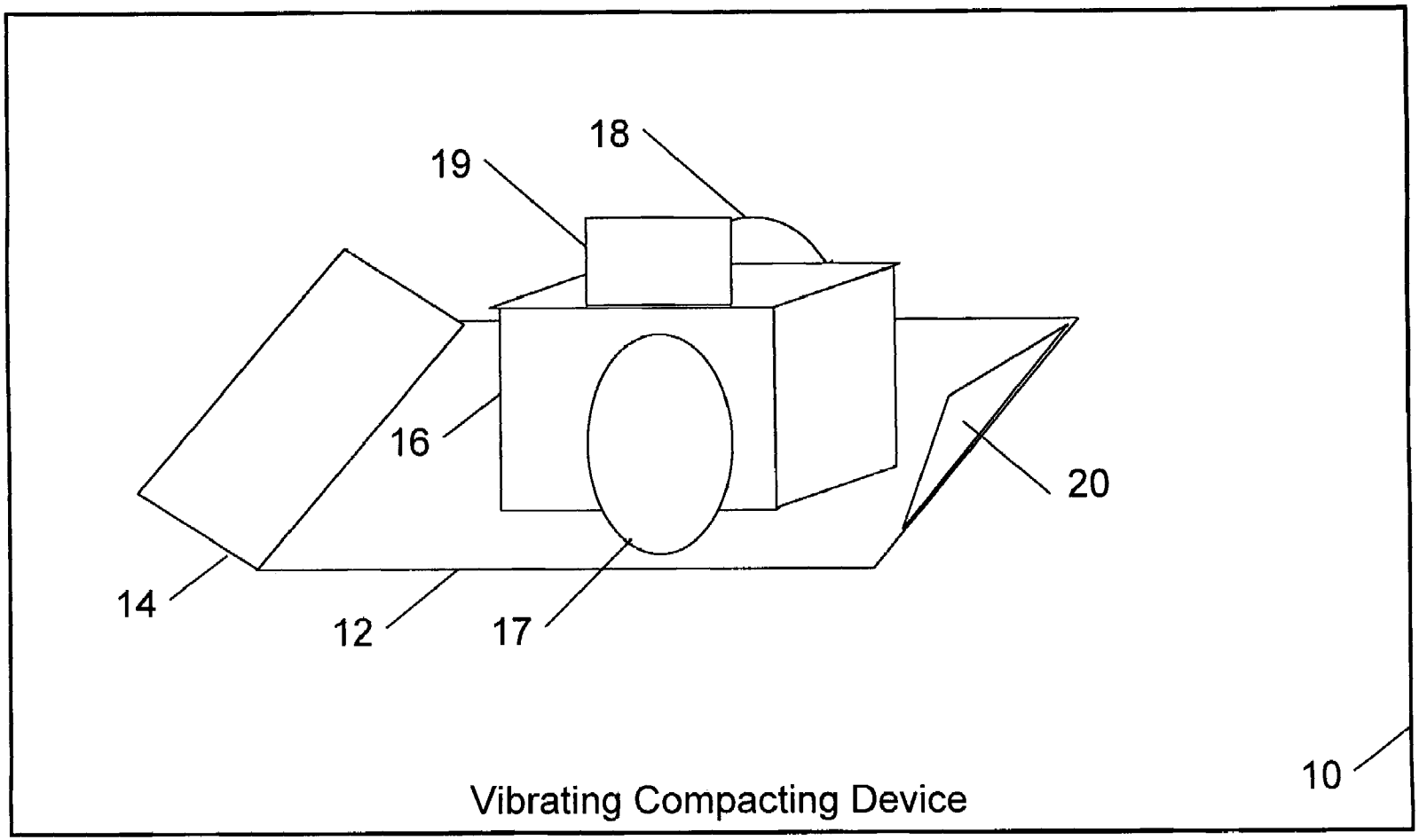
FIG. 1 is an illustration of a vibrating compaction device with a primary plate and a secondary compaction plate, according to the invention.

This invention is based on the idea of using multiple compaction plates of varying shapes and sizes to concentrate the force applied by a vibrating compaction plate to increase compaction rates of newly applied asphalt. Referring to figures, wherein like parts are designated with the same reference numerals and symbols, FIG. 1 is an illustration of a vibrating compaction device 10 with a primary compaction plate 12 and a secondary compaction plate 14, according to the invention. The primary compaction plate 12 is similar to those well-known in the art of asphalt compaction devices. A motor 16 or engine provides kinetic energy for an up-and-down movement of the primary compaction plate 12 resulting in a vibration of the plate against the surface of the asphalt. One method of providing this up-and-down movement is to connect an eccentric 17 to the motor 16. A second eccentric 18 may be connected to a generator 19 which is, in turn, powered by the motor 16. In this manner, two eccentrics having imparting different magnitudes of force may be synchronized. Alternatively, the two eccentrics may be connected by a shaft, with the second eccentric free-turning until it is hydraulically locked to the shaft.

A user pushes and steers the vibrating compaction device 10, which is facilitated by the reduction of force exerted by the vibrating compaction device 10 during each cycle of its vibration. Alternatively, the force exerted by the first or second eccentrics 17, 18 may impart a forward motion as well, requiring only that the user steer the vibrating compaction device and control the velocity of forward motion.

The vibrating compaction device 10 may be rotated to bring the secondary compaction plate 14 in contact with the surface of the asphalt. In this embodiment of the invention, the secondary compaction plate is the same width as the primary compaction plate 12 but has a smaller length resulting in a small footprint. The motor 16 continues to produce a force equivalent to that normally applied through the primary compaction plate. However, since the footprint of the secondary compaction plate has a smaller contact area, the force exerted by the vibrating compaction device 10 is concentrated into a smaller area. In this manner, the ability of the vibrating compaction device 10 to compact the asphalt is increased, resulting in a higher compaction rate than can be achieved using the primary compaction plate 12.

Alternatively, the primary compaction plate 12 may be integrated with the secondary compaction plate 14 to form a unified compaction plate with a first and second surface. Here, the second surface is affixed to the first surface in a manner that forms a 135 degree angle between the two surfaces. However, the invention is not limited to any specific angle and may include an angle equal to or greater than 90 degrees and less than or equal to 180 degrees.

This embodiment of the vibrating compaction device 10 of includes a tertiary compaction plate 20. In this embodiment of the invention, the tertiary compaction plate 20 has a width which is less than that of the primary compaction plate 12. Additionally, the tertiary plate may be formed in the shape of a semi-circle, an ellipse, a free-form shape, a triangle, or other polygon. Because the surface area of the tertiary compaction plate 20 is less than that of the primary compaction plate 10 and the secondary compaction plate, the tertiary compaction plate 20 may be used to apply even more force to the surface of the asphalt, thus increasing the rate of compaction. The non-traditional shape of the tertiary compaction plate 20 may be used to concentrate the force of the vibrating compaction device 10 along a focused path, such as a seam or newly filled-in trench. In an alternate embodiment of the invention, the secondary compaction plate may also include a non-traditional shape such as a semi-circle, ellipse, free-form shape, triangle, or other polygon. Additionally, the primary compaction plate 10 may include a plurality of surfaces including a primary, secondary, and tertiary surface.

Figure 2:
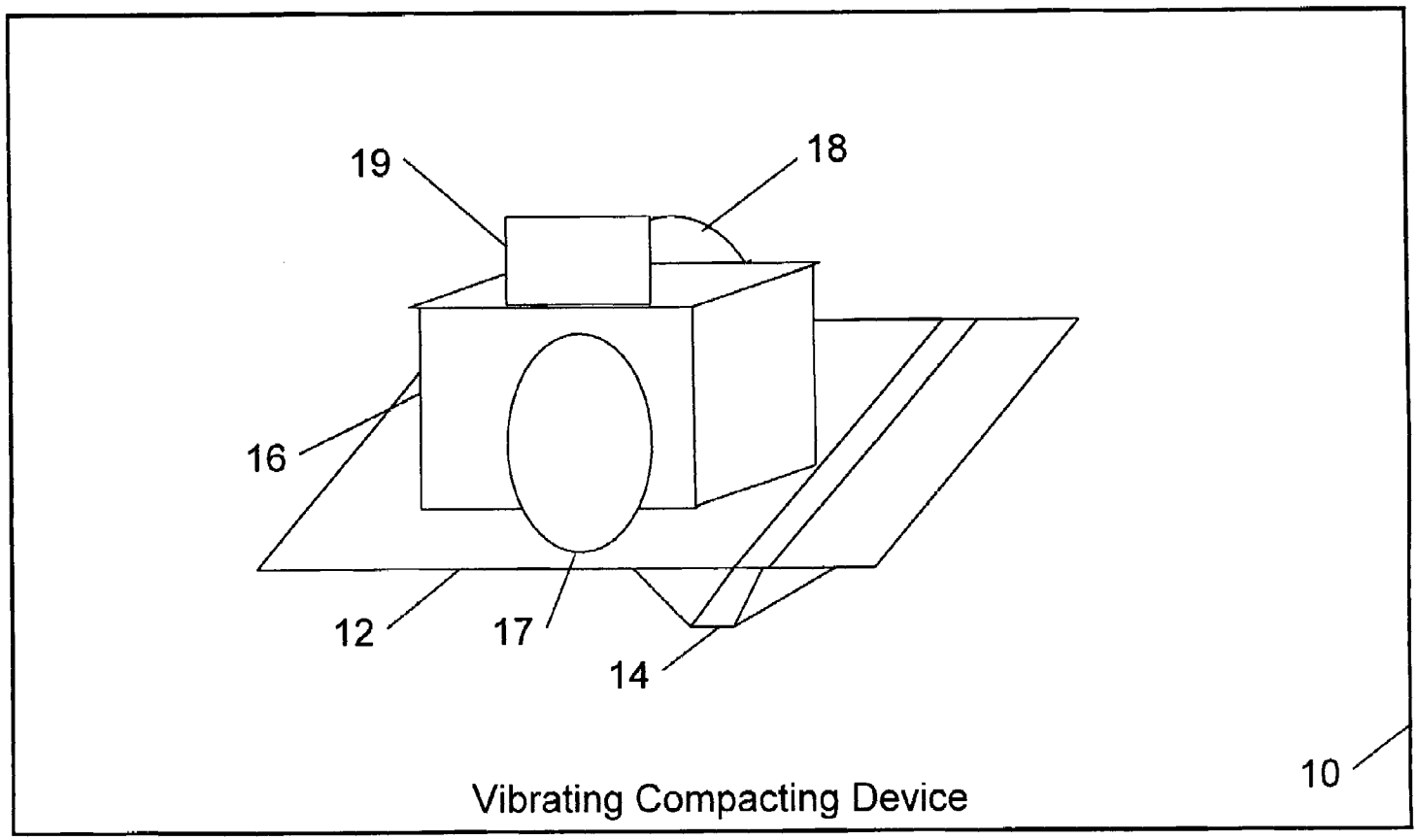
FIG. 2 is an illustration of a vibrating compaction device with a secondary compaction plate that can be extended and retracted.

FIG. 2 is an illustration of a vibrating compaction device 10 with a secondary compaction plate 14 that can be extended and retracted with respect to the primary compaction plate 12. In this embodiment of the invention, the width of the secondary compaction plate 14 is the same as that of the primary compaction plate 12. However, the secondary compaction plate 14 may assume any width, either less than, equal to, or greater than that of the primary compaction plate. Likewise, while this embodiment of the invention includes a rectangular secondary compaction plate 14, the secondary compaction plate 14 may assume any shape. The result is that the secondary compaction plate 14 may be extended away from the primary compaction plate resulting in a focused application of the vibrating compaction device's downward force. Additionally, the secondary compaction plate 14 may be retracted so that its application surface (side facing the asphalt) is flush with or recessed above that of the primary compaction plate.

Figure 3:
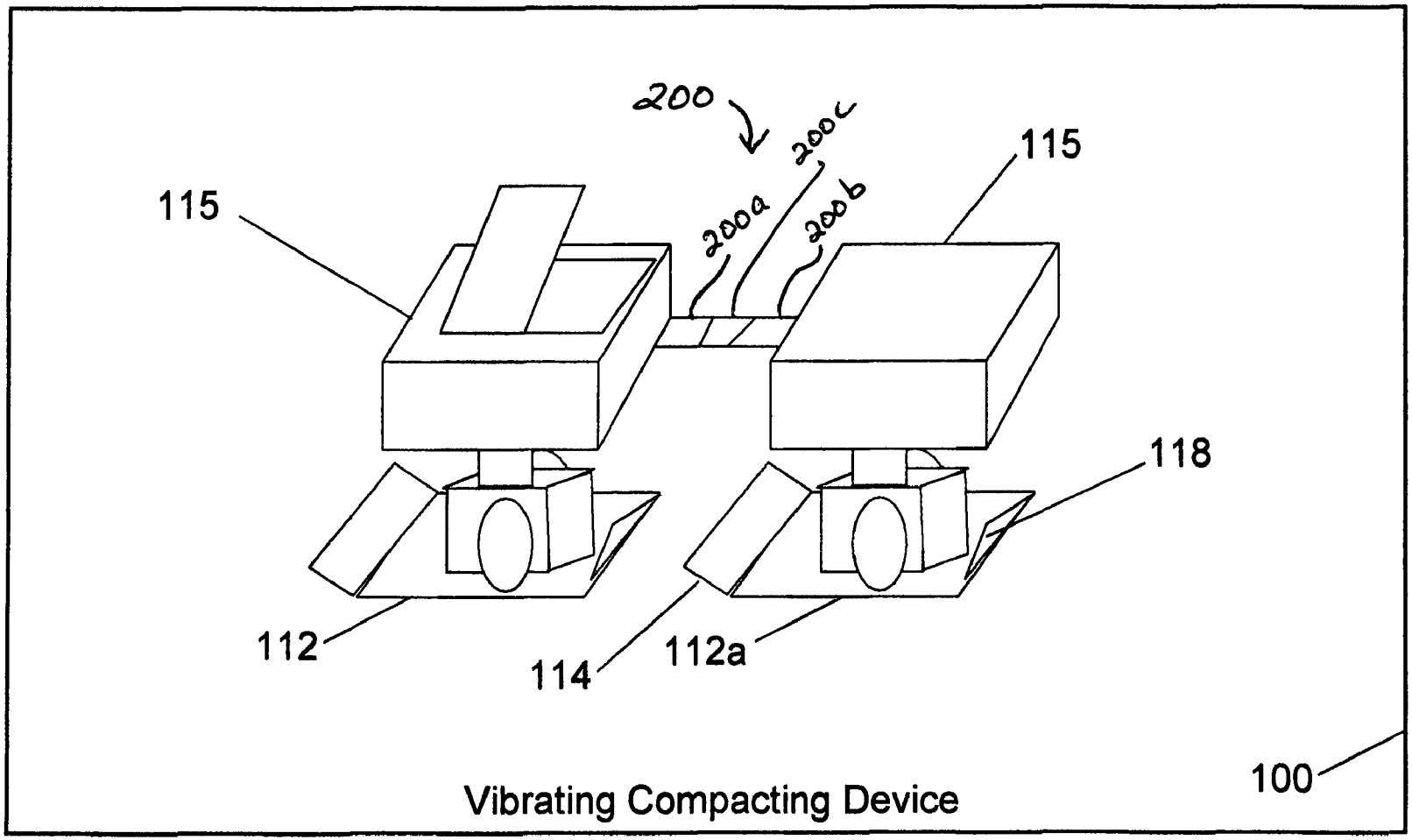
FIG. 3 is an illustration of an articulated vibrating compaction device with a pair of primary compaction plates and a secondary compaction plate, according to the invention.
Figure 4:
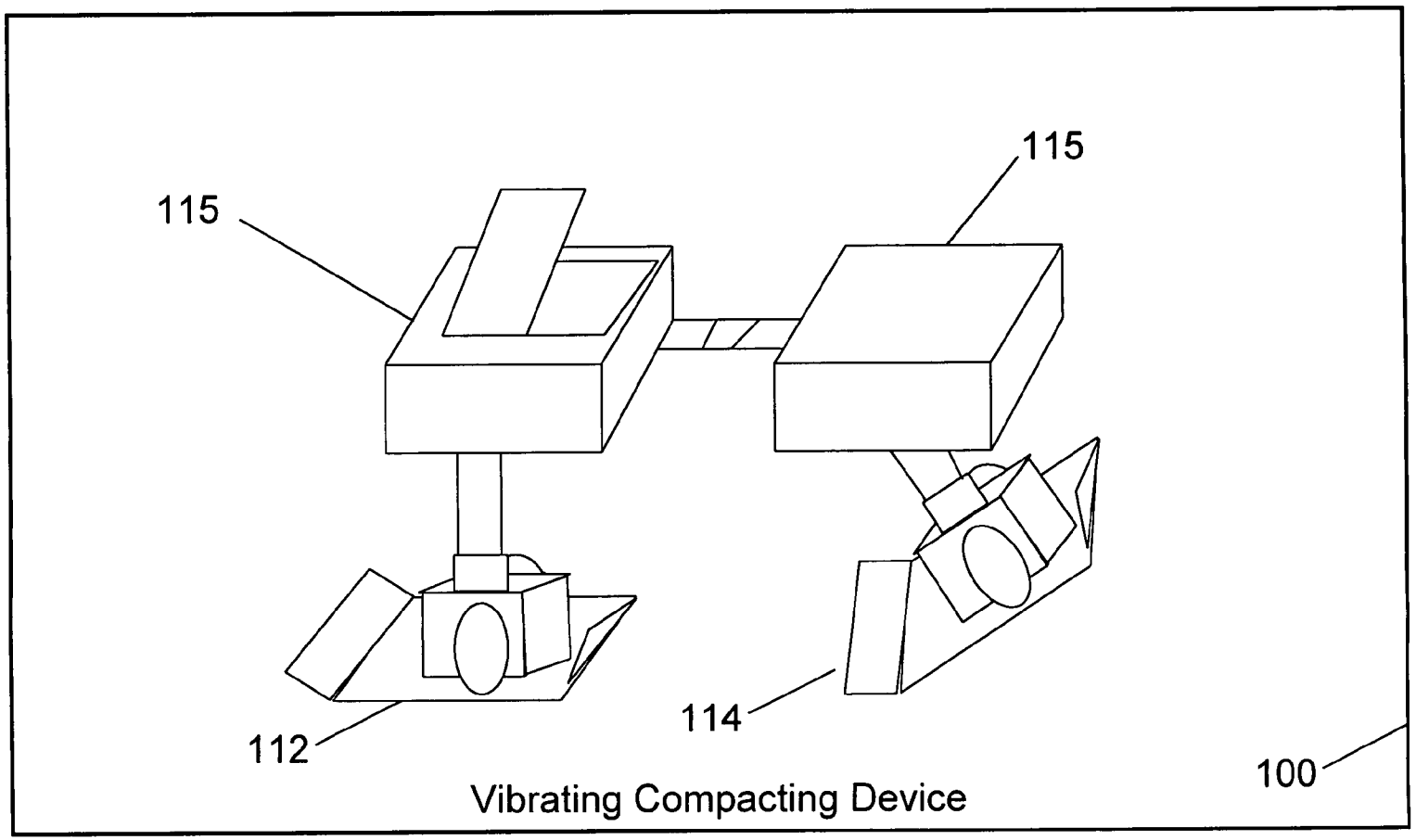
FIG. 4 is an illustration of the articulated vibrating compaction device of FIG. 4 illustrating the application of the secondary compaction plate.

FIG. 3 is an illustration of an articulated vibrating compaction device 100 with a pair of primary compaction plates 112 and an optional secondary compaction plate 114, according to the invention. In this embodiment of the invention, the articulated connection 200 includes a front portion 200*a*, a back portion 200*b*, and a pivot wherein the front portion 200*a* is connected to one segment 115 and the back portion 200*b* is connected to a second segment 115 and the articulated are used to steer the articulate vibrating compaction device by allowing the first segment to rotate relative to the second segment in a relatively horizontal plane. Forward motion is provided by the motion imparted by the eccentric 117. A first primary compaction plate 112*a* may be rotated that the secondary compaction plate 114 is applied to the surface to be compacted, as illustrated in FIG. 4. Additionally, the articulated vibrating compaction device 100 may include additional secondary compaction plates or tertiary compaction plates 118.

Figure 5:
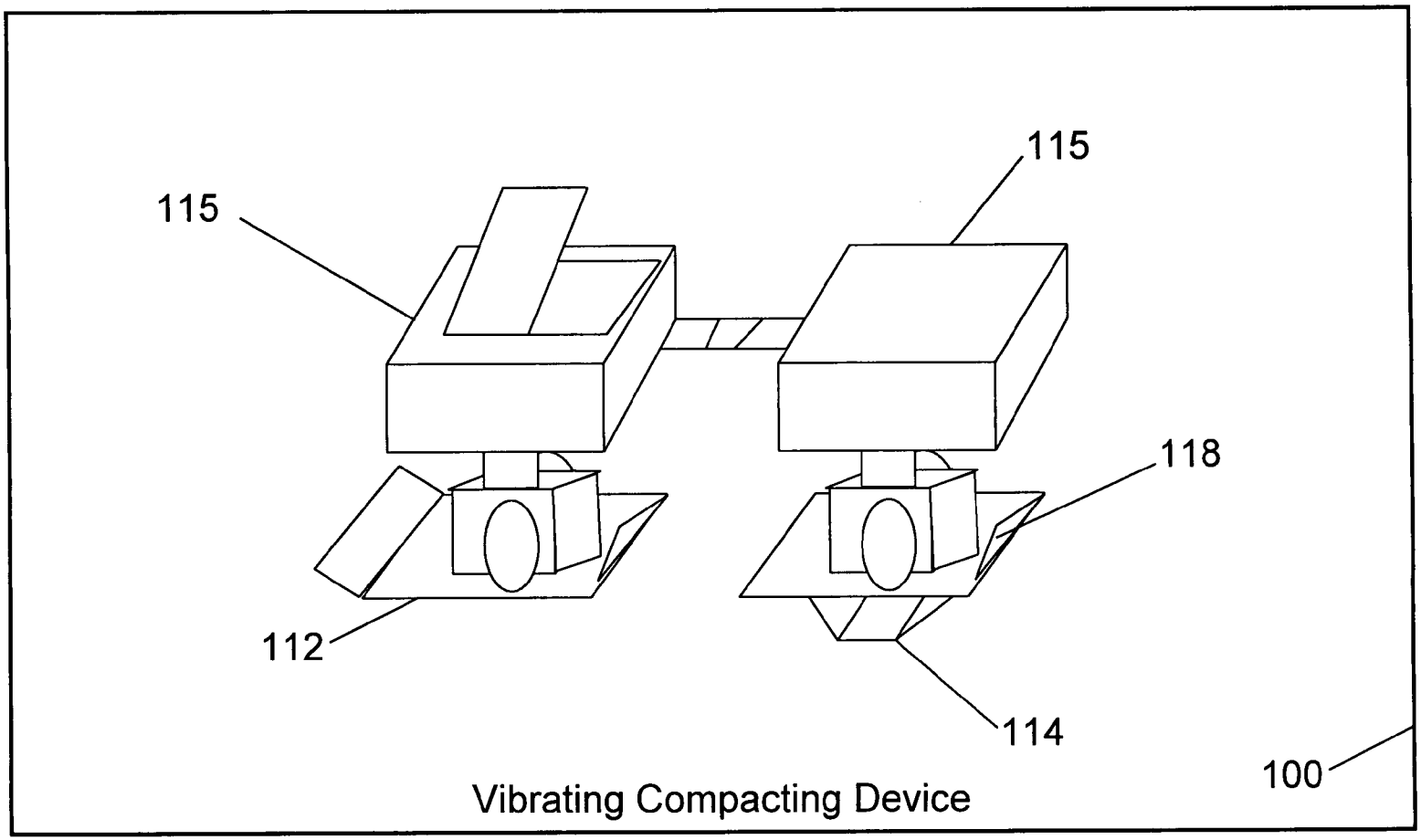
FIG. 5 is an illustration of an articulated vibrating compaction device with a secondary compaction plate that can be extended and retracted.

FIG. 5 is an illustration of an articulated vibrating compaction device 100 with a secondary compaction plate 114 that can be extended and retracted with respect to one of the primary compaction plates 112. While this embodiment of the invention includes a rectangular secondary compaction plate 114, the secondary compaction plate 114 may assume any usable shape. The result is that the secondary compaction plate 114 may be extended away from the primary compaction plate resulting in a focused application of the vibrating compaction device's downward force. Additionally, the secondary compaction plate 114 may be retracted so that its application surface (side facing the asphalt) is flush with or recessed above that of the primary compaction plate.

Those skilled in the art of making asphalt compaction systems may develop other embodiments of the present invention. However, the terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. An articulated vibrating compaction device, comprising:

a first segment comprising a first vibration source for producing a first oscillating force, in mechanical communication with a primary compaction plate comprising a first surface area adapted to transmit the first oscillating force;

a second segment; and an articulated connection including a front portion connected to the first segment, a back portion connected to the second segment, and a pivot wherein the articulated connection is adapted to connect the second segment to the first segment in a manner that allows the first segment to rotate about the pivot relative to the second segment in a relatively horizontal plane;

and wherein the articulated connection is adapted to steer the articulated vibrating compaction device by allowing the first segment to rotate about the articulated connection in a relatively horizontal plane.

2. The articulated vibrating compaction device of claim 1, wherein the primary compaction plate comprises a second surface area directly connected to the first surface area wherein the first segment may be rotated so as to allow the second surface area to transmit the first oscillating force.

3. The articulated vibrating compaction device of claim 2, wherein the the first surface area and the second surface area form an angle.

4. The articulated vibrating compaction device of claim 2, wherein the first segment is adapted to allow the second surface area to be displaced relative to the primary compaction.

5. The articulated vibrating compaction device of claim 2, wherein the primary compaction plate comprises a third surface directly connected to the first surface area wherein the third surface area is adapted to transmit the first oscillating force.

6. The articulated vibrating compaction device of claim 1, wherein the second segment comprises a second vibration source for producing a second oscillating force.

* * * * *